US005237955A

United States Patent [19]

Jennings

[11] Patent Number: 5,237,955

[45] Date of Patent: Aug. 24, 1993

[54] FLAG DISPLAY DEVICE

[76] Inventor: Robert W. Jennings, 28 Munson St., Greenfield, Mass. 01301

[21] Appl. No.: 940,093

[22] Filed: Sep. 3, 1992

[51] Int. Cl.[5] ..... G09F 17/00

[52] U.S. Cl. ..... 116/174; 248/289.1; 411/396

[58] Field of Search ..... 116/173, 174, 175; 248/289.1, 316.5; 411/378, 383, 396

[56] References Cited

U.S. PATENT DOCUMENTS

| | | | |
|---|---|---|---|
| 982,645 | 1/1911 | Suhr | 116/174 |
| 1,253,380 | 1/1918 | Hoffman | 116/174 |
| 4,603,652 | 8/1986 | Thibault et al. | 116/174 |
| 4,852,733 | 8/1989 | Blume | 206/223 |
| 4,864,962 | 9/1989 | Kuehl et al. | 116/174 |

FOREIGN PATENT DOCUMENTS

| | | | |
|---|---|---|---|
| 0528483 | 3/1957 | Belgium | 411/378 |
| 0657594 | 3/1938 | Fed. Rep. of Germany | 411/378 |
| 0621884 | 2/1981 | Switzerland | 116/174 |

OTHER PUBLICATIONS

Windsport No-Flip Flag Clip (advertisement 1989).

*Primary Examiner*—William A. Cuchlinski, Jr.
*Assistant Examiner*—W. Morris Worth
*Attorney, Agent, or Firm*—Chapin, Neal & Dempsey

[57] ABSTRACT

A device which is fastened at or near the top of a flagpole includes an arm which extends perpendicularly to the flagpole and has a clip positioned at or near an end of the arm. The clip engages a flag along its upper edge when fully extended. The device is fastened to the flagpole using a mounting fixture which comprises a bolt which extends transversely through a bore provided in the flagpole. The arm is angled to form a short pivot section rotatably disposed in a bore transversely through the bolt.

6 Claims, 3 Drawing Sheets

FLAG DISPLAY DEVICE

This invention relates to an improved apparatus for displaying a flag in its extended position, and more particularly, to a device used in conjunction with a flagpole which prevents the flag from becoming fouled or entangled around the pole.

BACKGROUND OF THE INVENTION

While on display on a flagpole, shifting or brisk breezes frequently cause flags to become wrapped around the flagpole. When this occurs, if the flag is to be properly displayed, it must be unwrapped manually. In such conditions, a flag must be untangled frequently and it can become a tedious and burdensome task.

Also, in many circumstances, flags are mounted on vertical or nearly vertical flagpoles. In such a configuration, a flag will be oriented for its best display only in the presence of a relatively brisk breeze, one that serves to fully extend the flag. In the absence of such a breeze, the flag will hang limp against the pole and consequently will not be presented for most favorable viewing.

U.S. Pat. No. 4,864,962 discloses rotatable clips that mount in circumferential grooves on the flagpole and are intended to prevent the flag from becoming fouled around the flagpole by allowing the flag to rotate freely around the pole. These clips have a tendency to bind or catch so as not to rotate freely about the flagpole and thus fail to prevent the flag from becoming furled about the pole. Additionally, the flag may sometimes wrap around the pole in moderate wind conditions which lacks the force to cause the clips to rotate about the pole and thus prevents the flag from being wrapped thereabout. Moreover, such rotatable clips include no provision for holding the flag in its extended position on days of insufficient wind.

U.S. Pat. No. 4,852,733 discloses clips similar to U.S. Pat. No. 4,864,962 as discused above, except that the clips do not rotate in circumferential grooves in the flagpole, but instead are used in conjunction with a tapered flagpole having a lower diameter greater than that of an upper diameter. These clips have the same disadvantages as those disclosed in the '962 Patent with the additional disadvantage of being less able to rotate freely about the flagpole.

It is an object of this invention to provide a lightweight, inexpensive and effective apparatus or device which prevents a flag from becoming tangled or furled around a flagpole on which it is being displayed.

An additional object of the present invention is to provide a lightweight, inexpensive and highly effective device which holds a flag in its substantially extended condition for most favorable display of the flag on a flagpole even in situations of little or no wind.

According to this invention, a pivotable arm is adapted to be fitted onto a flagpole near the top thereof and which extends radially from the longitudinal axis of the flagpole and includes a fastener engageable with an upper edge portion of a flag to retain the same in generally perpendicular orientation to the pole.

The above and other objects and advantages of this invention will be more readily apparent from a reading of the following description taken in conjunction with the following drawing.

DETAILED DESCRIPTION OF THE PREFERRED EMBODIMENT

Figures 1, 2, 3, 4:
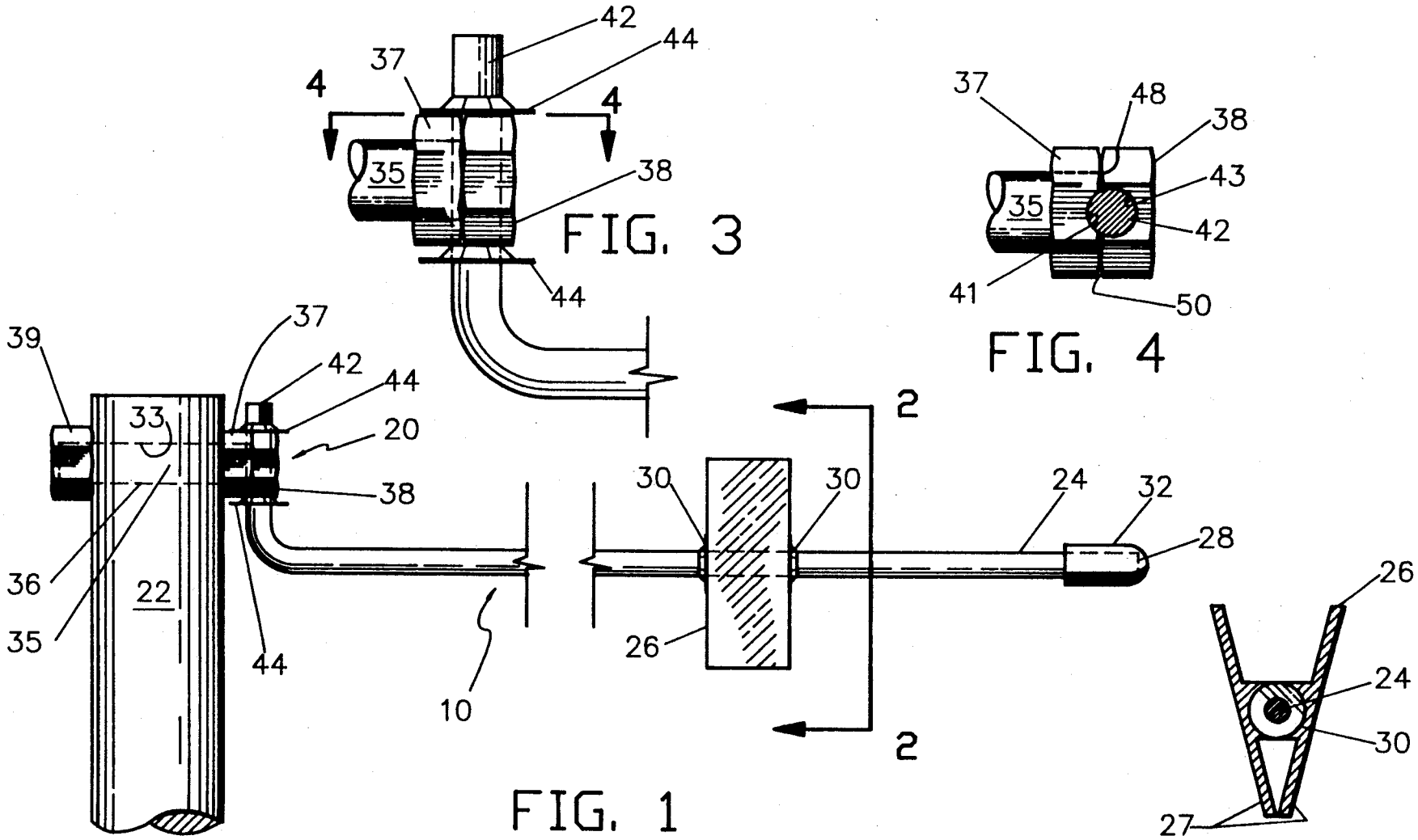
FIG. 1 is an elevational view of a device of the type embodying the invention.
FIG. 2 is a cross-sectional view taken along line 2—2 of FIG. 1.
FIG. 3 is an enlarged, partially broken away elevational view of the mounting apparatus of FIG. 1 removed from the flagpole.
FIG. 4 is a cross-sectional view taken along line 4—4 of FIG. 3.

Referring now to FIG. 1, a flag displaying device shown generally at 10 comprises mounting means or a fixture 20 adapted to fasten an arm 24 at or near the top of a flagpole 22. Arm 24, as shown in FIG. 2, which may take the form of a rod of circular cross-section, extends perpendicularly from the flagpole 22 and has a fastener or clip 26 positioned at or near the outer or distal end 28 of arm 24. The clip 26 is prevented from sliding along the arm 24 by one-way washers or push-on retainers 30. A flag (not shown) would be mounted substantially at the top of the flagpole 22 in the usual manner and jaws 27 of the clip 26 secured to the flag at a point along its upper edge adjacent its free-end or when disposed in its fully extended position. A protective plug 32 of rubber or plastic may be disposed onto end 28 of arm 24.

As shown in FIGS. 1 and 3, fixture 20 comprises a securing member 36 shown in this embodiment as a rod or bolt adapted to be fitted through a transverse hole or bore 33 which may be drilled through the flagpole 22. The bolt 36 has a shank portion 35 threaded at one end and a hexagonal head portion 38 disposed at its other end. The bolt may be secured by a lock-nut 39 which threads onto the bolt 36 in a conventional manner.

Arm 24 has an upwardly angled pivot portion 42 at an end of the arm disposed at a right angle to the arm which extends transversely through a bore 43 in the bolt 36, as shown in FIGS. 3 and 4. The bore 43 extends vertically through the head portion 38 of the bolt as well as adjacent shank portion 35 of the bolt. Semi-cylindrical recesses 41 formed on diametrically opposite sides of a ring shaped spacer or nut 37 complete the bore 43. The pivot section 42 of the arm 24, when disposed in bore 43, is free to rotate through an angle of approximately 270 degrees about its longitudinal axis.

As best shown in FIGS. 3 and 4, the ring shaped spacer or nut 37 is fitted onto the shank portion 35 and interposed between the flagpole 22 and the head portion 38 of the bolt 36. The spacer 37 has an inner diameter large enough to fit over the threaded end of shank portion 35 and an inner surface 48 which is positioned adjacent to and abuts an underside surface 50 of head 38 and is provided with semi-cylindrical recesses 41 which form a portion of the bore 43. The bore 43 is thus defined by the portions through the head 38, shank 35 and recesses 41 in spacer 37. Pivot section 42 is axially secured by one-way washers or similar mechanical retainers 44 which may be similar to washers 30 and serve to restrict movement by pivot section 42 in its longitudinal direction.

This arrangement of the bolt 36 and spacer 37 acts to provide an inexpensive bushing which secures the arm 24 on the flagpole while permitting the pivot section 42 to rotate freely and smoothly about its vertical axis in bore 43. The arm 24, however, can only rotate approximately 270 degrees before contacting the flagpole 22. Thus, the arm (and therefore the flag to which the arm is engaged) has a wide range of rotational motion relative to the flagpole to allow for a variety of wind directions. Being prevented, however, from rotating completely around the flagpole, the arm thereby prevents the flag from becoming fouled. The arrangement is inexpensive due to the ready availability of teh parts and the simplicity of the construction. Accordingly, the invention provides an extremely effective yet inexpensive solution to the problem of tangled or furled flags.

Furthermore, the device embodying the present invention is simple to use. Once the device is mounted at the top of a flagpole, a flag is hoisted or positioned on the flagpole in a usual manner. Then, the upper edge of the flag is simply engaged by the jaws 27 of the clip 26 to secure the flag to the clip.

Figure 5:
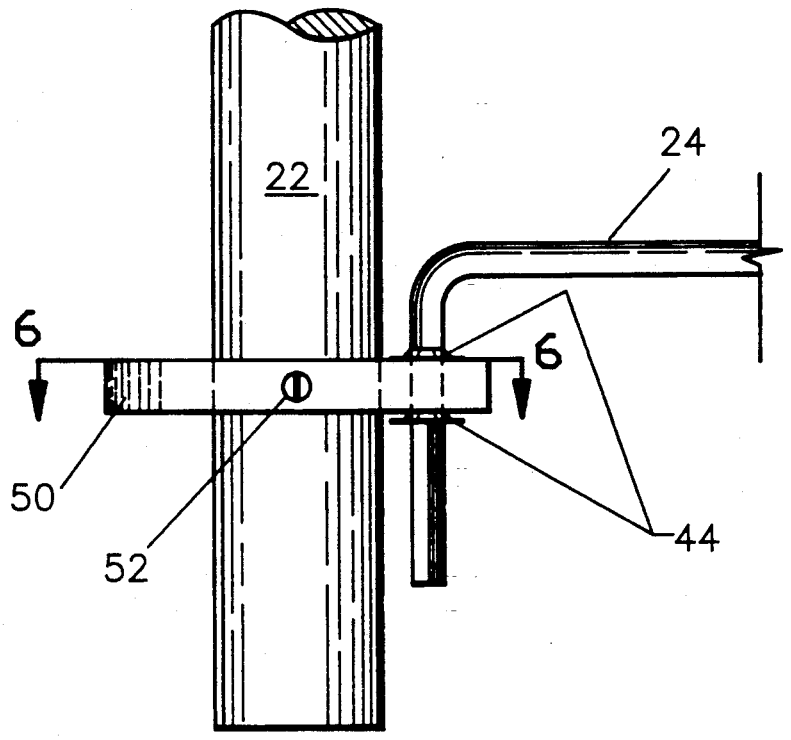
FIG. 5 is an elevational view of an alternative embodiment of a device of the type embodying the invention.
Figure 6:
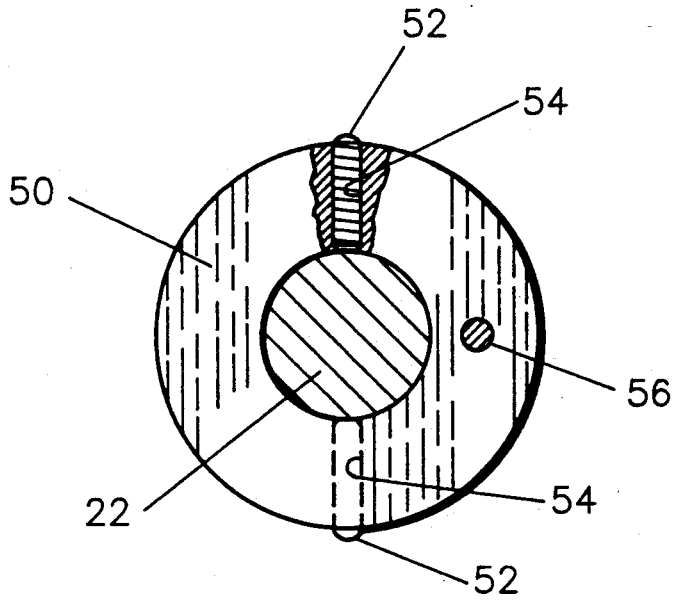
FIG. 6 is a partially broken away cross-sectional view taken along line 6—6 of FIG. 5.

Referring now to FIGS. 5 and 6, an alternative embodiment of the invention includes a ring or collar 50 disposed circumferentially about the flagpole 22. The collar 50 has one or more threaded set-screws or other tightening devices 52 disposed within threaded bores 54 which are disposed radially through the collar 50. The set-screws 52 can be tightened to securely engage the flagpole 22. Collar 50 additionally has a vertical bore 56 through which the pivot portion 42 of the arm 24 is pivotably engaged in the manner previously described.

Figure 7:
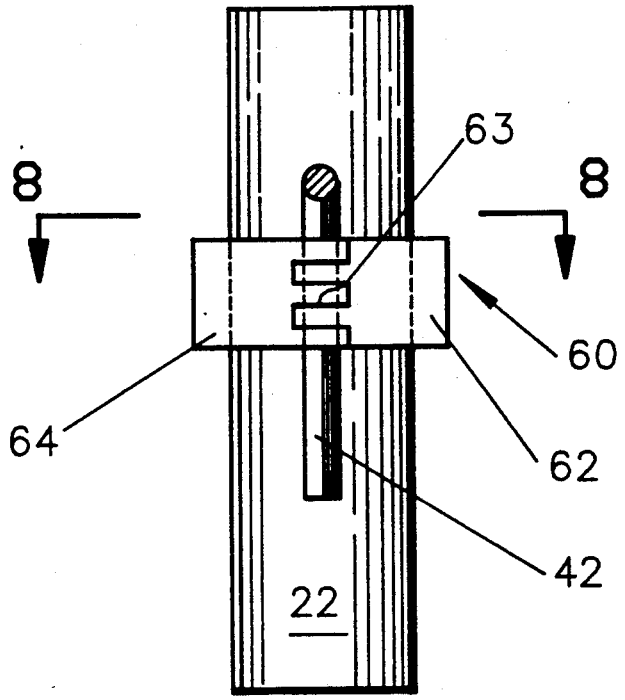
FIG. 7 is an elevational view of an alternative embodiment of a device of the type embodying the invention.
Figure 8:
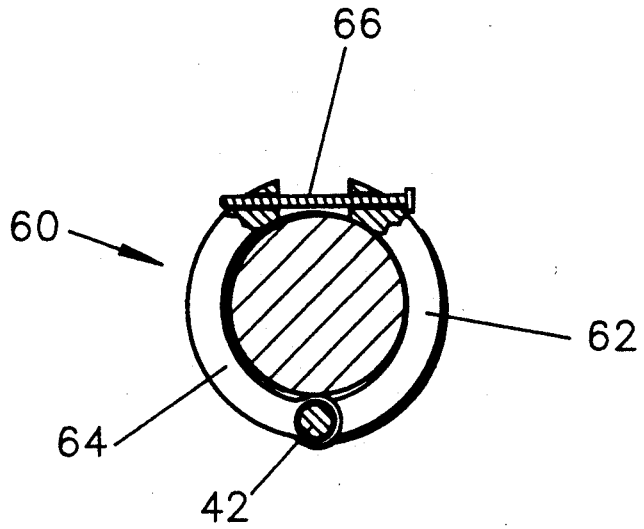
FIG. 8 is a cross-sectional view taken along line 8—8 of FIG. 7.

Referring to FIGS. 7 and 8, a still further embodiment comprises a hinged clamp 60 which is disposed about flagpole 22. Hinged clamp 60 has two opposite side or jaw portions 62 and 64 hingedly interconnected, as at 63, by the pivot section 42 of the arm 24 which section also serves as the hinge pin. The free-ends of the jaws 62 and 64, opposite from the pivot section 42, are secured by a threaded screw member 66 which engages side portions 62 and 64 in a conventional manner to secure the clamp portion 60 to the flagpole 22. In this configuration, the pivot section 42, while also serving as the hinge-pin of the hinge 63, is adapted to rotate about its longitudinal axis pursuant to the above described invention.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

What is claimed is:

1. A flag display device adapted to be used in conjunction with a flagpole comprising means for mounting said device onto the flagpole, an arm rotatably supported by said mounting means, said arm having an inner end portion rotatably supported by said mounting means and an outer end portion extending generally perpendicularly to the longitudinal axis of the flagpole and a fastener carried by said arm on the outer end portion thereof and engageable with an upper edge of a flag to hold the flag in extended planar relationship from the flagpole in various wind conditions, said mounting means comprising a bolt having a shank portion, a head portion disposed at an end of said shank portion and a cylindrical bore extending transversely through said bolt.

2. A flag display device, as set forth in claim 1 wherein said bore extends through said bolt at the interface of said shank portion and head portion.

3. A flag display device, as set forth in claim 1, wherein a major portion of said bore is disposed in said head portion.

4. A flag support device, as set forth in claim 3, wherein said inner end portion of said arm extends at approximately a right angle to the remainder of said arm and is cylindrical in cross-section and being rotatably disposed within the bore through the head and shank portions of said bolt.

5. A flag display device, as set forth in claim 4, wherein a spacer is disposed on said bolt between said head portion and said flagpole, said spacer having recess portions which define portions of said bore.

6. A flag display device adapted to be used in conjunction with a flagpole comprising means for mounting said device onto said flagpole, an arm pivotably supported by said mounting means, said arm having an inner end portion pivotably supported by said mounting means and an outer end portion extending generally perpendicularly to the longitudinal axis of said flagpole and a fastener carried by said arm on the outer end portion thereof and engageable with an upper edge of a flag to hold the flag in extended planar relationship from the flagpole in various wind conditions, said mounting means comprising a clamp member having two jaw portions interconnected at one end thereof by a hinge, said inner end portion of said arm adapted to be fitted into said hinge to serve as a hinge-pin therefor as well as a pivot portion for said arm.

* * * * *